United States Patent [19]

Miller

[11] 4,034,522

[45] July 12, 1977

[54] PORTABLE BELT SANDER STAND

[76] Inventor: John Miller, Box 79, S. Chatham, Mass. 02659

[21] Appl. No.: 670,574

[22] Filed: Mar. 25, 1976

[51] Int. Cl.[2] ..... B24B 41/00

[52] U.S. Cl. ..... 51/166 R

[58] Field of Search ..... 51/166 R, 166 TS, 166 FB, 51/166 MH; 83/477.2

[56] References Cited

U.S. PATENT DOCUMENTS

| | | | |
|---|---|---|---|
| 2,997,900 | 8/1961 | Pugsley | 51/166 R |
| 3,871,137 | 3/1975 | Grammatico | 51/166 R |

*Primary Examiner*—James L. Jones, Jr.
*Attorney, Agent, or Firm*—Allen D. Brufsky

[57] ABSTRACT

A support stand for supporting a portable belt sander in a stationary position so a workpiece can be brought into contact with the belt. The stand has a base mounting a pair of spaced blocks receiving the handle of the belt sander therebetween which is seated on the base. A switch lever is mounted on the rear of the blocks and spans the space therebetween for depressing the trigger of the sander mounted in the handle to operate the sander in its supported, stationary position on the stand.

7 Claims, 4 Drawing Figures

FIG.1
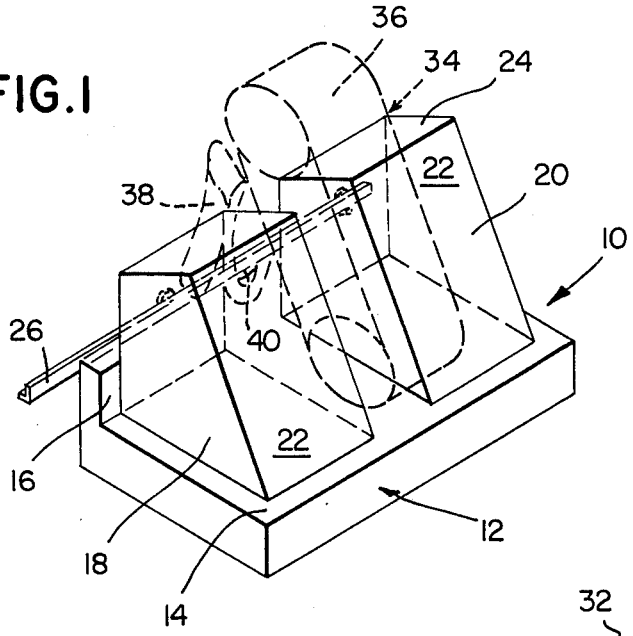
FIG.2
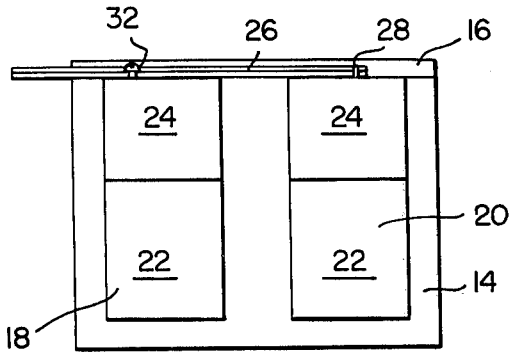
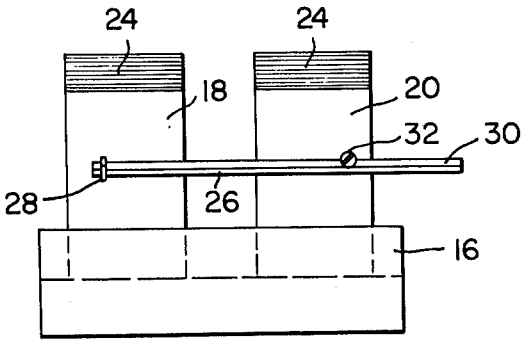
FIG.3
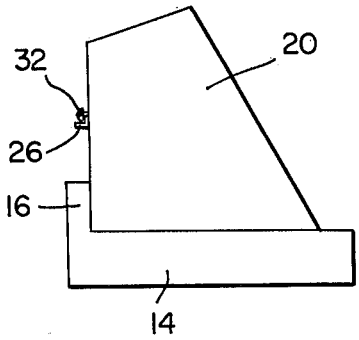
FIG.4

PORTABLE BELT SANDER STAND

BACKGROUND OF THE INVENTION

This invention relates to a support stand, and more particularly, a support stand for a portable, electrically-powered tool, such as a belt sander.

Often, it is more convenient to bring a workpiece into contact with a portable tool, rather than bringing the tool into contact with the workpiece. For example, in order to sharpen tool edges or knives, a portable tool such as a belt sander can easily be used for this purpose, if stationary.

SUMMARY OF THE INVENTION

Accordingly, this invention relates to a stationary support stand for holding a portable belt sander at an attitude wherein a workpiece can be brought into contact with the sander belt. The support stand includes a base having a pair of spaced, inclined upright blocks between which the handle of the tool is positioned, with the belt in front of the blocks. A switch lever in the form of an angle rod extends through an eyebolt on the rear surface of one of the blocks and the handle of the tool which is sealed on the base. The angle rod is held by the head of a screw on the other block in contact with the trigger of the tool within the handle to keep the trigger depressed and the sander belt in motion. Upon downward and backward motion of the angle rod to clear the screw head, the trigger will be released to stop operation of the tool.

BRIEF DESCRIPTION OF THE DRAWING

Further objects and advantages of the invention will become more apparent from the following description and claims, and from the accompanying drawing, wherein:

FIG. 1 is a perspective view of the support stand of the present invention with a portable belt sander illustrated in phantom lines supported on the stand;

FIG. 2 is a top plan view of the stand of FIG. 1;

FIG. 3 is a back view in elevation of the stand of FIG. 1; and

FIG. 4 is a side view in elevation of the stand of FIG. 1 as seen from the right-hand end of FIG. 3.

DETAILED DESCRIPTION OF THE PREFERRED EMBODIMENT

Referring now to the drawing in detail, wherein like numerals indicate like elements throughout the several views, the stand 10 of the present invention includes an L-shaped base 12 having a horizontal leg 14 and a vertical leg 16.

A pair of spaced wooden blocks or the like 18, 20 are connected to the horizontal leg 14 of base 12. Each of the blocks 18, 20 include an inclined top surface 24; the remaining surfaces being complemental in shape to base 12.

An angle rod 26, L-shaped in cross-section, is swivelly mounted within the head of an eyebolt 28 threaded into the rear surface of block 20. The upright leg 30 of angle rod 26 is normally positioned beneath the head of a screw 32 threaded into the rear surface of block 18 to hold rod 26 stationary in a substantially horizontal position.

A portable electrically-powered belt sander 34 having an endless sander belt 36 connected to a handle 38 is supported on stand 10 by inserting handle 38 between blocks 18 and 20 and resting motor housing of belt sander 34 on surface 24 of blocks 18 and 20. Belt 36 will assume an inclined attitude in front of the inclined surfaces 22 of blocks 18, 20.

Angle rod 26 is inserted through handle 38 into the head of eyebolt 28 and when its other end is positioned beneath the head of screw 32 it will assume a stationary, horizontal position depressing the trigger 40 of belt sander 34 to activate the rotation of sander belt 36. Upon downward and backward motion of the angle rod 26 to clear head of screw 32, trigger 40 will be released to stop operation of sander 34. In this manner, angle rod 26 serves as a switch lever for stationary belt sander 34 supported on stand 10.

I claim:

1. A support stand for a portable power tool having a handle and trigger for actuating operation of the tool when depressed, said stand comprising:

a base, a pair of spaced upright blocks mounted on said base adapted to receive therebetween the handle of said power tool supported on said base, and means connected to said blocks spanning the space between said blocks for insertion through the handle of said tool inserted between said blocks to depress the trigger of the tool and maintain said trigger in its depressed state to operate said tool, said last name means including a rod, means on one of said blocks for swivelly receiving one end of said rod, and stop means on the other end of said blocks for holding said rod stationary.

2. A support stand in accordance with claim 1 wherein said swivel means includes a ring mounted on one of said blocks.

3. A support stand in accordance with claim 1 wherein each of said blocks includes a front inclined surface.

4. A support stand in accordance with claim 1 wherein said base has a horizontal leg on which said blocks are mounted, and a vertical leg for supporting the handle of said tool.

5. A support stand in accordance with claim 1 wherein: said rod is substantially L-shaped in cross-section

6. A support stand in all with claim 2 wherein said ring includes:

the head of an eyebolt inserted in said one block.

7. A support stand in all with claim 6 wherein said stop means includes:

the head of a screw inserted in the other of said blocks for abutment with the upright leg of said L-shaped rod.

* * * * *